73-664 SR
8/6/85 XR 4,532,975

United States Patent [19]

Ives

[11] Patent Number: 4,532,975

[45] Date of Patent: Aug. 6, 1985

[54] CONTINUOUS CASTING MOLD OSCILLATOR LOAD INDICATION SYSTEM

[75] Inventor: Kenneth D. Ives, Valparaiso, Ind.

[73] Assignee: United States Steel Corporation, Pittsburgh, Pa.

[21] Appl. No.: 489,619

[22] Filed: Apr. 28, 1983

[51] Int. Cl.[3] ..... B22D 11/16

[52] U.S. Cl. ..... 164/150; 164/416; 164/154; 73/664

[58] Field of Search ..... 164/150, 154, 416, 451, 164/478; 73/664

[56] References Cited

U.S. PATENT DOCUMENTS 3,557,865 1/1971 Gallucci et al. .

FOREIGN PATENT DOCUMENTS 0032864 2/1982 Japan ..... 164/150
0072760 5/1982 Japan ..... 164/150
1556616 11/1979 United Kingdom .

OTHER PUBLICATIONS

EP-44-291-Abstract.

*Primary Examiner*—Nicholas P. Godici
*Assistant Examiner*—Maureen Weikert
*Attorney, Agent, or Firm*—David J. Cushing

[57] ABSTRACT

A load indication system monitors not only the total frictional load on the mold oscillator in a continuous casting apparatus, but also monitors the difference in the oscillator load at various locations around the mold to detect mold wobble and load imbalance. In addition, both the total frictional load and the mold wobble are monitored by detecting their peak-to-peak values.

20 Claims, 3 Drawing Figures

CONTINUOUS CASTING MOLD OSCILLATOR LOAD INDICATION SYSTEM

BACKGROUND OF THE INVENTION

This invention relates to continuous casting systems, and more particularly to such a system in which the mold is oscillated during casting. Still more particularly, the invention is directed to a method and apparatus for monitoring the operation of the mold oscillating mechanism so as to decrease surface defects and increase the service life of the mold itself.

Continuous casting systems are well known in which a relatively long casting is obtained from a small mold. In conventional continuous casting systems, molten metal is poured into a mold where it is cooled. A plug or "dummy bar" is inserted through the bottom of the mold and the molten metal begins to harden and adhere to the plug. The mold sidewalls are typically water-cooled, and the molten metal therefore cools faster from the outside. Once the metal develops a skin of sufficient thickness, the plug is withdrawn from the bottom of the mold and the still molten metal at the interior of the bar continues to cool and harden outside of the mold. The plug is continuously withdrawn from the mold and the molten metal is continuously poured into the mold at a rate such that the cooling time of the metal within the mold will allow a sufficiently strong skin to be maintained, and in this way a relatively long casting can be achieved.

In such a system, it is imperative that the friction between the mold sidewalls and the skin be minimized to permit the partially cooled metal bar to be drawn out of the mold. Excessively high friction can lead to defects in the casting and, in the worst case, can result in tearing of the skin if the bar continues to be pulled and the skin sticks to the mold sidewall. This may result in "breakout" where the still-molten metal at the interior of the bar escapes through a tear in the skin.

Various methods have been devised for eliminating, or at least reducing to an acceptable level, the friction which occurs within continuous casting molds. One such method is to bathe the inner surface of the mold with a lubricant. This is not entirely satisfactory, since the lubricant is often burned away before it applies the desired lubrication. Another method, and the one to which the present invention is directed, involves continuous oscillation of the mold during casting. The oscillation of the mold in the axial direction of the casting bar provides a high degree of slippage between the mold and the metal, thereby reducing the level of friction. The oscillating method is typically used in conjunction with a lubricant, or casting flux. It is imperative, however, that the friction between the oscillating mold and the casting be monitored. In the event that excessive friction occurs, some corrective action may be taken, or the casting apparatus may be shut down to avoid the occurrence of breakout.

The most convenient technique for monitoring friction between the mold and casting is to monitor the load on the oscillating mechanism. Grenfell, in his British Patent Specification No. 1,556,616, discloses an arrangement which includes transducers between the mold and the support table to weigh the mold so that both the static weight of the mold and the apparent weight of the mold during withdrawal can be determined and utilized to establish the frictional force. Grenfell compares the waveform of the frictional signal with an earlier-obtained reference waveform, and diagnoses an abnormal condition whenever the frictional signal waveform exceeds the reference waveform in either direction. Thus, the diagnosis is based upon the absolute level of the frictional signal. One problem with such a system is that there are a number of conditions which may change during operation of the mold to increase or decrease the force required to oscillate the mold, and these other factors may have no bearing whatsoever on the friction between the steel and the mold sidewalls. For example, there are a number of hoses connected to the oscillating mold table to provide the cooling water to the mold, and these hoses must continually flex during mold oscillation. These hoses may become somewhat stiffer with age and thereby increase the force required to oscillate the mold. This will raise the level of the friction signal waveform, and may result in false indications of excessive friction.

A further drawback of the Grenfell system is that, since the absolute level of the frictional signal is used for diagnostic purposes, it is necessary that a reference, or zero level be accurately determined prior to a casting operation.

Another technique disclosed in European Pat. No. 44,291 utilizes four load cells, one at each corner of the mold table. The outputs from the four load cells are summed to obtain a total force signal which is then adjusted in accordance with the static weight of the mold and an accelerometer-generated signal allegedly corresponding to the dynamic mass of the mold. The final result is a signal roughly indicative of the friction between the casting and mold sidewalls.

The European patent system continually displays both the frictional signal and the peak value thereof, but this system is similar to the Grenfell system in that the monitored signals are representative of the absolute level of friction. Thus, the technique described in the European Patent is subject to the same disadvantages as the Grenfell system.

A still further technique is disclosed in U.S. Pat. No. 3,893,502 to Slamar. According to this technique, the armature current of the motor used to oscillate the mold is monitored. Slamar discloses the measurement of the free-running load (i.e., the load on the motor during oscillation of an empty mold) to determine how much of the load monitored during a casting operation is due to mold friction. In Slamar, the friction signal is integrated over a number of cycles, e.g. ten to twenty cycles of mold oscillation, and control is carried out in accordance with the integrated signal rather than the peak signal as in the two previously discussed systems. However, the Slamar system is similar in that the integrated frictional signal is an indication of the absolute load or friction. The Slamar system will be subject to an "aliasing" or biasing error in that the reading may vary depending on where each measurement cycle begins. A further disadvantage of the Slamar system is that the integration of the frictional signal over a predetermined number of oscillating cycles necessarily slows the response time of the shut-down mechanism. For example, if the excessive friction occurs near the end of one twenty-cycle integration period, the overall integrated value may not show up as excessive, and an excessive friction condition will not be diagnosed until the end of the next twenty-cycle integration period.

The above-discussed friction monitoring systems are thus subject to a common disadvantage, i.e. their diagnoses are performed on the basis of an absolute frictional or load level.

A further disadvantage in the above systems is that each provides helpful information concerning the total frictional force data, but none monitors other aspects of mold oscillation which may affect the quality of the final product. For example, a parallel smooth oscillation at all four corners of the mold is required to achieve a smooth cast surface. If the oscillator action is not uniform, the cast surface will have excessive oscillator marks and may even tear. Non-uniformity in the magnitude of the oscillator load at each of the four corners may result in some increase in the mold friction, but may cause undesirable surface defects long before the total frictional force becomes excessive. In addition, excessive wobbling of the oscillating mechanism will increase the wear and thereby decrease the useful life of the oscillating mechanism.

It is therefore an object of this invention to provide a continuous casting mold oscillator load indicator which provides a more accurate indication of an excessive friction condition and which does not require a zero or reference level to be accurately determined prior to operation.

It is a further object of this invention to provide a continuous casting mold oscillator load indicator which will enhance the quality of the cast product and will increase the service life of the oscillator system.

It is a still further object of this invention to provide a monitoring system for a continuous casting mold oscillation apparatus which provides, in addition to information on the total amount of friction present along the walls of the mold, information regarding non-uniformity of the oscillation at different locations around the mold.

SUMMARY OF THE INVENTION

Briefly, these and other objects of the invention are achieved by providing a continuous casting mold oscillation system with load cells used to couple the oscillating force either directly or indirectly to the mold at various locations around the mold. The loads measured on the different load cells are summed to obtain a signal corresponding to the total oscillating force during a casting operation. A free-running total load signal is obtained from the load cells prior to a casting operation, and this free-running load signal is subtracted from the actual load during casting to obtain a signal indicating the amount of the load which is due to mold friction. The frictional signal is then provided to a wave level detection circuit which provides an output signal representing the peak-to-peak value of the friction. An alarm is then sounded when the peak-to-peak value exceeds a predetermined maximum permissible level. Since a peak-to-peak level of the signal is monitored rather than the absolute level, no accurate determination of a reference level need be made prior to operation, and any shift in the overall level of the friction signal which may occur due to factors other than mold friction will have no substantial effect on the accuracy of the friction detection.

In actuality, it may be preferable to determine the peak-to-peak value of the tatal load signal prior to subtraction of the free-running total load signal, to permit the subtraction of two substantially DC values. The important feature of the friction detection according to the present invention, however, is that the excessive friction detection is performed by monitoring the peak-to-peak value of the friction signal.

In addition to the information concerning the total frictional force, the present invention generates wobble information by comparing the loads measured on the various load cells. This is preferably accomplished by designating one of the n load cells as a reference cell and generating (n − 1) different signals corresponding to the difference between the reference cell output and the output of each of the remaining load cells. These wobble signals can be monitored and the casting apparatus can be shut down or adjusted if an excessive amount of wobble is occurring. The wobble signals will indicate the phase difference or non-uniformity in the wobbling or oscillating motion at the locations of respective load cells. As is the case with the total frictional signal, the peak-to-peak values of these wobble signals can be monitored.

BRIEF DESCRIPTION OF THE DRAWINGS

The invention will be more clearly understood from the following description in conjunction with the accompanying drawings in which.

DETAILED DESCRIPTION OF THE INVENTION

Figure 1:
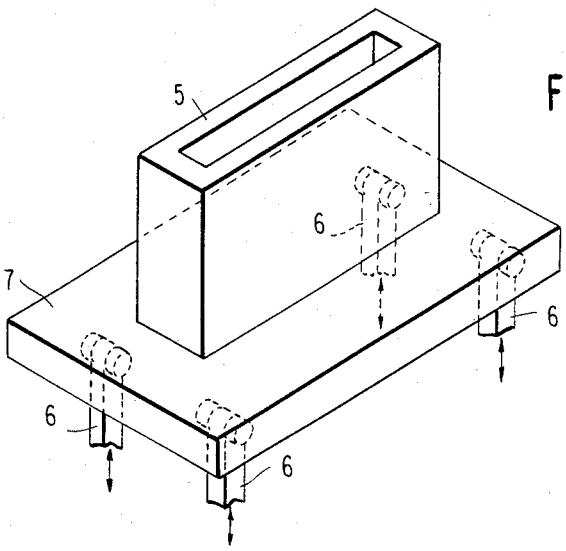
FIG. 1 is a brief sketch illustrating the type of system to which the present invention is directed.

FIG. 1 is an explanatory diagram for illustrating the concept of the present invention in an oscillating mold system. The mold 5 may be vertically oscillated by cranks 6 at each of the four corners of the mold table 7. In normal practice, the cranks 6 may be coupled to the mold table 7 via load cell pins 1–4, and the mold 5 is fixed to the mold table and is oscillated together with the mold table. The details of such a configuration are well known in the art and need not be explained in detail here. The important feature is that the oscillating forces are coupled to various places around the mold (usually the four corners as illustrated) via individual load cells, which are preferably load cell pins as illustrated but could be other known types of load cells without departing from the scope of the invention.

Figure 2:
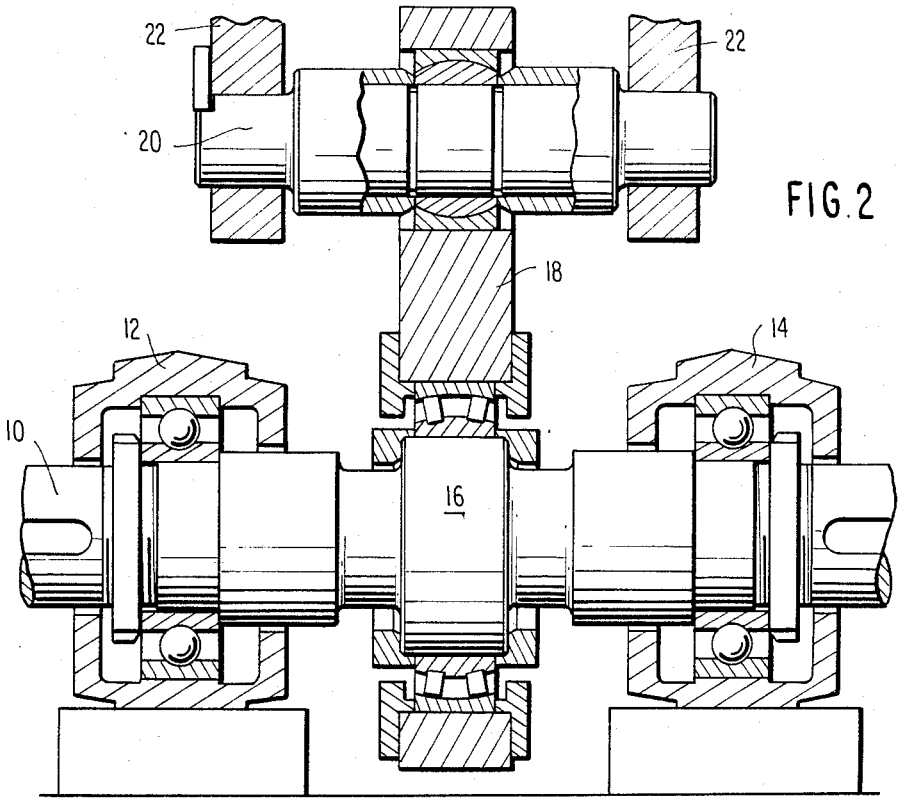
FIG. 2 is a more detailed illustration of a suitable type of oscillating mechanism which may be employed in continuous casting apparatus.

FIG. 2 illustrates in more detail a suitable mechanism which may be used to couple the oscillating force to each corner of the mold table. As shown in FIG. 2, a shaft 10 is rotatably supported by bearings 12 and 14 and includes an eccentric portion 16. A crank 18 riding on the eccentric portion 16 will vertically reciprocate as the shaft 10 rotates. A pin 20 rotatably coupled to the upper end of the crank 18 is fixed to the mold table 22 and, as the crank 18 vertically reciprocates, this vertical reciprocation, or oscillation, will be imparted through the pin 20 to the mold table 22. In a preferred embodiment, the load cell pin 20 will have internal strain gauges for sensing the shear strain on the pin. The cell may be rated at approximately 50,000 pounds at 1 MV/V output. Such cells are well-known and can be obtained from a number of sources. The shaft 10 will turn at a speed of approximately 1 hertz, to thereby impart approximately a one-half inch vertical oscillation to the mold.

Figure 3:
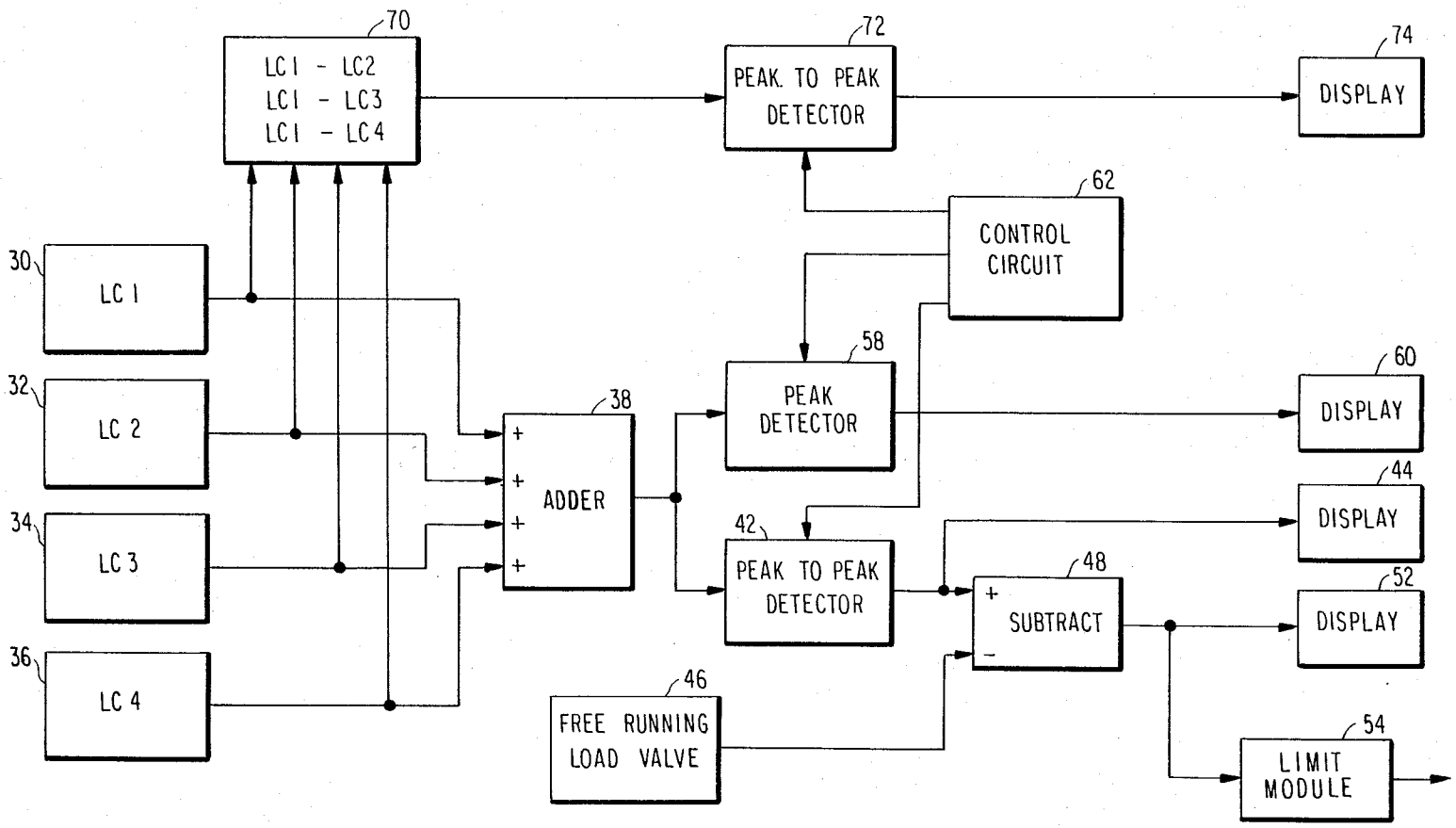
FIG. 3 is a brief block diagram of signal conditioning circuitry employed in the load indication system according to the present invention.

FIG. 3 is a brief block diagram of the signal processing circuitry according to the present invention. The illustrated circuitry includes load cell signal conditioners 30, 32, 34 and 36 for providing output signals representing the sensed loads on load cells 1, 2, 3 and 4, respectively. These load cell outputs can be provided to an adder 38 which will add together all four load signals to obtain a total load signal. The adder 38 may, for example, comprise two summation circuits with a first summation circuit computing a first sum A=(LC1+LC2) and a second sum B=(LC3+LC4), where, e.g., LC1 indicates the output from signal conditioner 30 representing the load of load cell 1, and a second summation circuit combining the signals A and B to obtain a signal SUM (A+B) corresponding to the total load amongst all load cells. This total load signal is provided to a wave level detector 42 which will provide an output representing the peak-to-peak value of the total load signal, and this peak-to-peak value signal may be provided to a digital indicator 44 for display.

Prior to the casting operation, the free-running total load signal would have been measured and set into a thumbwheel module 46. The output of detector 42 corresponding to the peak-to-peak value of the total load signal during the casting operation will be provided to a subtractor circuit 48 where the free-running signal will be subtracted, thereby achieving a friction signal indicating the amount of the measured load which is attributable to mold friction during the casting operation. This signal corresponding to the peak-to-peak value of the mold friction is then provided to a second digital indicator 52 for display.

Whenever the peak-to-peak value of the mold friction exceeds some upper limit value, the limit module 54 provides an excessive friction signal at its output line 56. This excessive friction signal can be used to trigger a visual or audible alarm and/or can be used to effect some corrective or protective function such as adjusting the cooling rate of the mold or shutting down the system entirely in order to prevent a possible breakout.

Since the excessive friction condition is determined in accordance with the peak-to-peak value of the friction signal, the diagnosis will be substantially immune to changing factors such as the flexibility of connection hoses or an increase or decrease in the amount of water in the mold at any one time, which factors may raise or lower the overall level of the friction signal but do not directly affect mold friction. In addition, since only the peak-to-peak value of the friction signal is considered, it is only necessary to establish free-running a peak-to-peak reference level prior to a casting operation.

It may in some instances also be desirable to monitor the peak load during operation, and for this purpose the total load signal from adder 38 may be provided to a peak detector 58 which will provide its output to a corresponding digital display 60.

The load and frictional signals are monitored for periods of time, e.g., ten or twenty oscillation cycles, and the peak detector 58 and peak-to-peak detector 42 are reset at appropriate intervals by a control circuit 62 which essentially serves merely a timing function. However, it should be noted that, even though the monitoring is performed over predetermined time intervals, the monitored friction signal is not integrated. Thus, if an excessive friction condition occurs near the end of a monitoring cycle, it will show up immediately at the output of subtractor 48 and will result in prompt detection of the breakout danger.

In addition to the above-discussed circuitry for providing a total friction indication, total load indication and breakout alarm, the present invention includes circuitry for generating a signal representing the degree of non-uniform oscillation. To this end, the load signals from signal conditioners 30–36 are provided to a calculation circuit 70 which compares the load at each cell to one of the load cells which is designated as reference cell, in the illustrated embodiment the reference cell being load cell 1. Assuming only four load cells, the summation circuit 70 will generate three difference signals (LC1−LC2), (LC1−LC3) and (LC1−LC4). These three signals will then be provided to a wave level detection circuit 72 which will examine the peak-to-peak value of each of the three difference signals. The peak-to-peak values of the three signals can be simultaneously displayed in the display unit 74. If the display unit 74 indicates that any one of the difference signals has becomes excessive, suitable corrective action may be taken. The peak-to-peak detector 72 is preferably reset by the control circuit 62 at the same frequency as the detectors 58 and 42.

The above signal processing circuitry is quite simple, and could be improved in a number of ways. For example, the friction signal, total load and wobble signals can be expected to vary as a function of speed, and the amount of variation will be dependent at least in part on the variation in the free-running signals as a function of speed. Additional instrumentation could be provided, if desired, to provide a compensation variable in accordance with the operating speed. It should also be appreciated that the number and types of load cells, cranks, etc. could be varied without departing from the spirit and scope of the invention. Further, the functions of many of the components illustrated in the block diagram of FIG. 3 could be collectively performed via software in a microprocessor. For example, the outputs of signal conditioners 30–36 could be monitored by the microprocessor during a test run with the mold empty to determine the free-running load value. The microprocessor could then automatically add some suitable increment to that load value, e.g., 12,000 lbs., and the incremented value of the friction signal could then be used as the alarm limit. Whatever changes may be made, it should be appreciated that the invention in its broadest aspect comprises the monitoring of the peak-to-peak frictional signal for breakout detection and/or the comparison of the load cell outputs to determine differences in the loading of various locations around the periphery of the mold.

I claim:

1. A continuous casting apparatus comprising:

a mold;

oscillating means for imparting an oscillating motion to said mold at a plurality of locations including at least first and second locations; and monitoring means for providing an indication of differences in the oscillating motion at said first and second locations, said monitoring means including first signalling means for providing a first output signal representing the oscillating motion at said first location, second signalling means for providing a second output signal representing the oscillating motion at said second location, means for comparing said first and second output signals to produce a comparison signal, and means for detecting the peak-to-peak value of said comparison signal as an indication of the difference in the oscillating motion at said first and second locations.

2. An apparatus as defined in claim 1, wherein said plurality of locations includes said first location and (n−1) additional locations one of which is said second location, and said monitoring means includes means for comparing said oscillating motion at said first location with the oscillation motion at each of said (n−1) additional locations.

3. A continuous casting apparatus of the type including a mold, oscillating means for imparting an oscillating motion to said mold at a plurality of locations, and signalling means for providing a plurality of signals representing the oscillating force applied to each of said plurality of locations, said signalling means comprising a plurality of load cells each providing an output signal representing the oscillating force at a respective one of said plurality of locations, said apparatus further comprising monitoring means for providing an indication of differences in the oscillating forces applied to each of said plurality of locations, said monitoring means including means for comparing output signals from said plurality of load cells to generate at least one comparison signal, and wave level detection means for detecting the peak-to-peak value of said at least one comparison signal.

4. A continuous casting apparatus as defined in claim 3, wherein said plurality of load cells comprises a first load cell and (n−1) additional load cells and wherein said monitoring means comprises means for comparing the output signals from each of said (n−1) additional load cells with the output signal from said first load cell to generate (n−1) comparison signals.

5. A continuous casting apparatus as defined in claim 4, wherein said wave level detection means generates signals indicating the peak-to-peak values of each of said (n−1) respective comparison signals.

6. A continuous casting apparatus as defined in claim 3, wherein said monitoring means further includes means for generating a total load signal substantially corresponding to the sum of said plurality of output signals.

7. A continuous casting apparatus as defined in claim 6, wherein said monitoring means further includes reference means for generating a reference signal substantially corresponding to the free-running loads on said plurality of load cells, and means for subtracting said reference signal from said total load signal to obtain a friction signal.

8. A continuous casting apparatus as defined in claim 7, wherein said monitoring means further includes second wave level detection means for generating a signal indicating the peak-to-peak value of at least said frictional signal.

9. A continuous casting mold oscillator load indicating system for use in a continuous casting apparatus of the type including a mold, oscillating means for imparting an oscillating motion to said mold at a plurality of locations and signalling means for providing a plurality of signals representing the oscillating force applied to each of said plurality of locations, said load indicating system comprising monitoring means for providing an indication of differences in the oscillating forces applied to each of said plurality of locations, said monitoring means including comparison means for comparing said plurality of signals to one another in order to obtain at least one comparison signal and wave level detection means for detecting the peak-to-peak value of said at least one comparison signal.

10. A load indicating system as defined in claim 9, wherein said signalling means comprises a plurality of load cell means, each providing an output signal indicating the load on said oscillating means at a respective one of said plurality of locations.

11. A load indicating system as defined in claim 10, wherein said plurality of load cell means comprises a first load cell means and (n−1) additional load cell means and wherein said comparison means compares the output signals from each of said (n−1) additional load cell means with the output signal from said first load cell means to generate (n−1) comparison signals.

12. A load indicating system as defined in claim 11, wherein said wave level detection means generates signals indicating the peak-to-peak values of each of said (n−1) respective comparison signals.

13. A load indicating system as defined in claim 10, wherein said monitoring means further includes means for generating a total load signal substantially corresponding to the sum of said plurality of output signals.

14. A load indicating system as defined in claim 13, wherein said monitoring means further includes reference means for generating a reference signal substantially corresponding to the free-running loads on said plurality of load cells, and means for subtracting said reference signal from said total load signal to obtain a friction signal.

15. A load indicating system as defined in claim 13, wherein said monitoring means further includes second wave level detection means for generating a signal indicating the peak-to-peak value of at least said friction signal.

16. A continuous casting mold oscillator load indicating system for use in a continuous casting apparatus of the type including a mold for containing mold contents, oscillating means for imparting an oscillating motion to said mold and means for providing at least one signal having a component representing friction betwen said mold and said mold contents, said signal varying in magnitude over the course of a single oscillation cycle of said mold, said system further comprising means for monitoring the peak-to-peak value of said signal.

17. A continuous casting mold oscillator load indicating system as defined in claim 16, wherein said means for providing comprises at least one signalling means for providing a load signal representing the load between said oscillating means and said mold, and said monitoring means includes peak-to-peak detection means for providing a first signal representing the peak-to-peak value of said load signal.

18. A continuous casting mold oscillator load indicating system as defined in claim 17, wherein said monitoring means further comprises means responsive to said first signal and to a reference signal for generating a second signal substantially representing the peak-to-peak value of the friction between said mold and said mold contents.

19. A continuous casting mold oscillator load indicating system as defined in claim 16, said means for providing comprising signalling means for generating a load signal representing the load between said mold and said oscillating means, said system further comprising reference means for generating a free-running signal representing the load between said mold and oscillating means when said mold is empty, said monitoring means monitoring the peak-to-peak value of the difference between said load signal and said free-running signal.

20. A continuous casting mold oscillator load indicating system as defined in claim 16, wherein said means for providing comprises a plurality of signalling means generating a plurality of load signals representing the load between said mold and said oscillating means at a plurality of respective locations around said mold, said system further comprising difference means for generating at least one difference signal corresponding to the difference in magnitude between at least two of said plurality of load signals, and peak-to-peak detection means for monitoring the peak-to-peak value of said at least one difference signal.

* * * * *